US008419132B2

(12) United States Patent
Jacobs

(10) Patent No.: US 8,419,132 B2
(45) Date of Patent: Apr. 16, 2013

(54) SWING CHAIR

(75) Inventor: Imre Peter Jacobs, Utrecht (NL)

(73) Assignee: Nuna International B.V., Amsterdam Zuidoost (NL)

( * ) Notice: Subject to any disclaimer, the term of this patent is extended or adjusted under 35 U.S.C. 154(b) by 149 days.

(21) Appl. No.: 12/283,751

(22) Filed: Sep. 15, 2008

(65) Prior Publication Data

US 2009/0085389 A1 Apr. 2, 2009

Related U.S. Application Data

(60) Provisional application No. 60/960,108, filed on Sep. 17, 2007.

(51) Int. Cl.
*A47C 1/00* (2006.01)

(52) U.S. Cl.
USPC ..... 297/344.21; 297/DIG. 11

(58) Field of Classification Search ..... 297/DIG. 11, 297/344.21, 344.26, 344.22, 351.4, 351.5, 297/461; 472/25, 114, 135
See application file for complete search history.

(56) References Cited

U.S. PATENT DOCUMENTS

| | | | | | |
|---|---|---|---|---|---|
| 401,302 | A * | 4/1889 | Purdy | 297/451.4 |
| 2,309,881 | A * | 2/1943 | Wise | 297/296 |
| 2,370,014 | A * | 2/1945 | Cunningham | 297/314 |
| 2,704,111 | A * | 3/1955 | Wunderlich | 297/274 |
| 3,071,410 | A * | 1/1963 | Gaskins | 297/464 |
| 3,147,972 | A * | 9/1964 | Borsuk | 472/29 |
| 3,741,514 | A * | 6/1973 | Snurr | 248/412 |
| 4,120,531 | A * | 10/1978 | Fefferman | 297/344.22 |
| 4,130,263 | A * | 12/1978 | Roericht | 248/371 |
| 4,858,991 | A * | 8/1989 | Boyesen | 297/195.11 |
| 4,976,494 | A * | 12/1990 | Polley | 297/464 |
| 5,042,864 | A * | 8/1991 | Mochizuki | 296/65.07 |
| 5,207,478 | A * | 5/1993 | Freese et al. | 297/296 |
| 5,364,163 | A * | 11/1994 | Hardison | 297/344.21 |
| 5,803,817 | A * | 9/1998 | Stern | 472/118 |
| 6,176,545 | B1 * | 1/2001 | Hambleton | 297/4 |
| D467,745 | S * | 12/2002 | Ryan | D6/364 |
| 6,619,742 | B1 * | 9/2003 | Bellefleur | 297/344.21 |
| 7,146,763 | B1 * | 12/2006 | Stanton | 43/21.2 |
| 7,401,856 | B2 * | 7/2008 | Marchand et al. | 297/314 |
| 7,416,197 | B2 * | 8/2008 | Mackin et al. | 280/87.041 |
| 7,563,170 | B2 * | 7/2009 | Bellows et al. | 472/29 |
| 7,575,276 | B1 * | 8/2009 | Henry | 297/256.12 |
| 7,727,078 | B2 * | 6/2010 | Arnold et al. | 472/118 |
| 7,824,273 | B2 * | 11/2010 | Clapper et al. | 472/95 |
| 7,905,549 | B2 * | 3/2011 | Lake et al. | 297/344.19 |
| 7,938,731 | B2 * | 5/2011 | Papageorge et al. | 472/29 |
| 8,047,609 | B2 * | 11/2011 | Chen et al. | 297/274 |
| 2003/0164633 | A1 * | 9/2003 | Jakus et al. | 297/271.5 |

(Continued)

FOREIGN PATENT DOCUMENTS

| | | |
|---|---|---|
| CN | 1745683 | 3/2006 |
| CN | 1879526 | 12/2006 |

*Primary Examiner* — David Dunn
*Assistant Examiner* — David E Allred
(74) *Attorney, Agent, or Firm* — David N. Lathrop

(57) ABSTRACT

A swing chair includes a base frame configured to rest on the floor and a support having a support surface arranged to support for instance a baby or a child, wherein the support is rotatably connected with the base frame by a bearing, wherein the axis of rotation of the bearing and the plane of the floor on which the base frame is arranged to rest are not mutually perpendicular.

28 Claims, 3 Drawing Sheets

U.S. PATENT DOCUMENTS

2007/0001499 A1* 1/2007 Smith ..... 297/362.13
2007/0111809 A1* 5/2007 Bellows et al. ..... 472/118
2008/0217974 A1* 9/2008 Velderman et al. ..... 297/256.16
2009/0001788 A1* 1/2009 Lenz et al. ..... 297/217.4
2010/0264711 A1* 10/2010 Nazari ..... 297/344.26
2011/0018320 A1* 1/2011 Schneider et al. ..... 297/216.17
2011/0095586 A1* 4/2011 Fernandez ..... 297/344.18
2012/0038194 A1* 2/2012 Tseng ..... 297/344.21
2012/0133185 A1* 5/2012 Tuckey et al. ..... 297/344.21
2012/0205954 A1* 8/2012 Pollack et al. ..... 297/344.21

* cited by examiner

SWING CHAIR

CROSS-REFERENCE TO RELATED APPLICATION

This application claims priority of U.S. Provisional Application No. 60/960,108, filed on Sep. 17, 2007.

BACKGROUND OF THE INVENTION

1. Field of the Invention

The invention relates to a swing chair comprising a base frame configured to rest on a floor and a support, such as a chair, having a support surface arranged to support a baby or a child, wherein the support is rotatably connected with the base frame by a bearing.

2. Description of the Related Art

Swings are well known, and usually comprise a base frame having a horizontal bar, and a chair suspended from said horizontal bar. The chair will move back-and-forth in a swinging motion, by initially pushing the chair out of balance. Apart from use as a toy, such devices are also designed for babies, wherein the chair is replaced by a cradle. The swing movement, which can be back-and-forth or lateral, is usually experienced as very pleasant by babies, so that they become and/or remain quiet.

The invention aims at a compact alternative swing device that has similar or better effects, and which can be easily stored in a compact space.

SUMMARY OF THE INVENTION

In accordance with the invention an axis of rotation of the bearing and a plane of the floor on which the base frame is arranged to rest are not mutually perpendicular.

Preferably the support surface extends from a higher portion arranged to carry a child's head or shoulders to a lower portion arranged to carry a child's legs or feet, and the bearing is connected with the support near the lower portion of the support surface.

In this manner a very compact swing chair is obtained, wherein the chair swings in a lateral direction. A further effect of this design may be that the chair may also show an up-and-down rocking movement, caused by the elastic properties of the frame/chair combination, having substantially a V-shape as seen from the side.

The feature that the axis of rotation of the bearing and the plane of the floor on which the base frame is arranged to rest are not mutually perpendicular means that an angle between the axis of rotation of the bearing and the plane of the floor on which the base frame is arranged to rest (angle $\alpha$ in FIG. 3) is smaller than 90 degrees, and said angle is preferably between 30 and 89 degrees.

In the preferred embodiment the support is free-rotatably connected with the base frame with as little friction as possible, for instance by making use of ball bearings. In an alternative embodiment the chair may also comprise a motorized actuator to continuously move the chair in a swinging motion.

In the preferred embodiment the bearing is connected with the base frame near a horizontal edge of the base frame, and the axis of the bearing is inclined in an upward direction towards a vertical axis through a centre of the base frame. In its neutral position the support is generally also inclined from the bearing in the upward direction towards the vertical axis through the centre of the base frame. In order to obtain a swing effect, the support must however be designed such that the centre of gravity of the support with a child (while the support surface is below said child) is below the axis of rotation of the bearing.

The base frame may for instance be substantially rectangular, oval, Y-shaped, V-shaped, square or ring shaped.

The distance between the lower portion of the support surface where the bearing is connected and the plane of the floor on which the base frame is arranged to rest is preferably less than 30 cm, more preferably less than 20 cm.

The support and its support surface are both preferably substantially shell shaped.

The support preferably comprises a harness or bumper bar for holding a child in position on the support surface.

The bearing is preferably comprised of a tube connected to one of the base frame and the support at one end and being open at its other end, and a shaft connected at one end to the other one of the base frame and the support, said shaft being rotatably mounted in said tube. Said shaft is preferably movable in an axial direction out of said tube, so that the support can be dismounted from the base frame.

BRIEF DESCRIPTION OF THE DRAWINGS

The invention will be further explained by means of the preferred embodiment as shown in the accompanying drawings, wherein.

DETAILED DESCRIPTION OF THE PREFERRED EMBODIMENT

Figure 1:
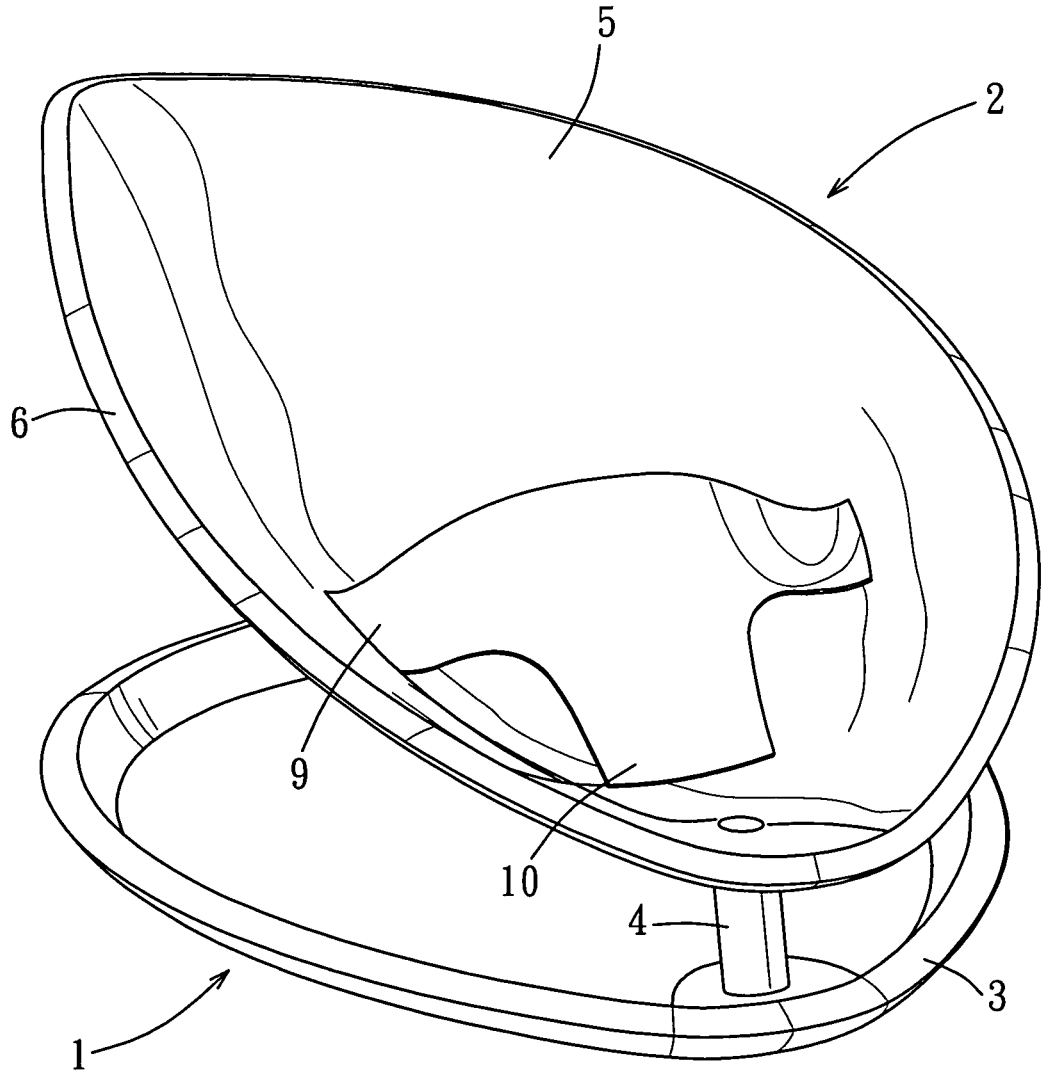
FIG. 1 is a perspective view of a swing chair in accordance with the invention.
Figure 2:
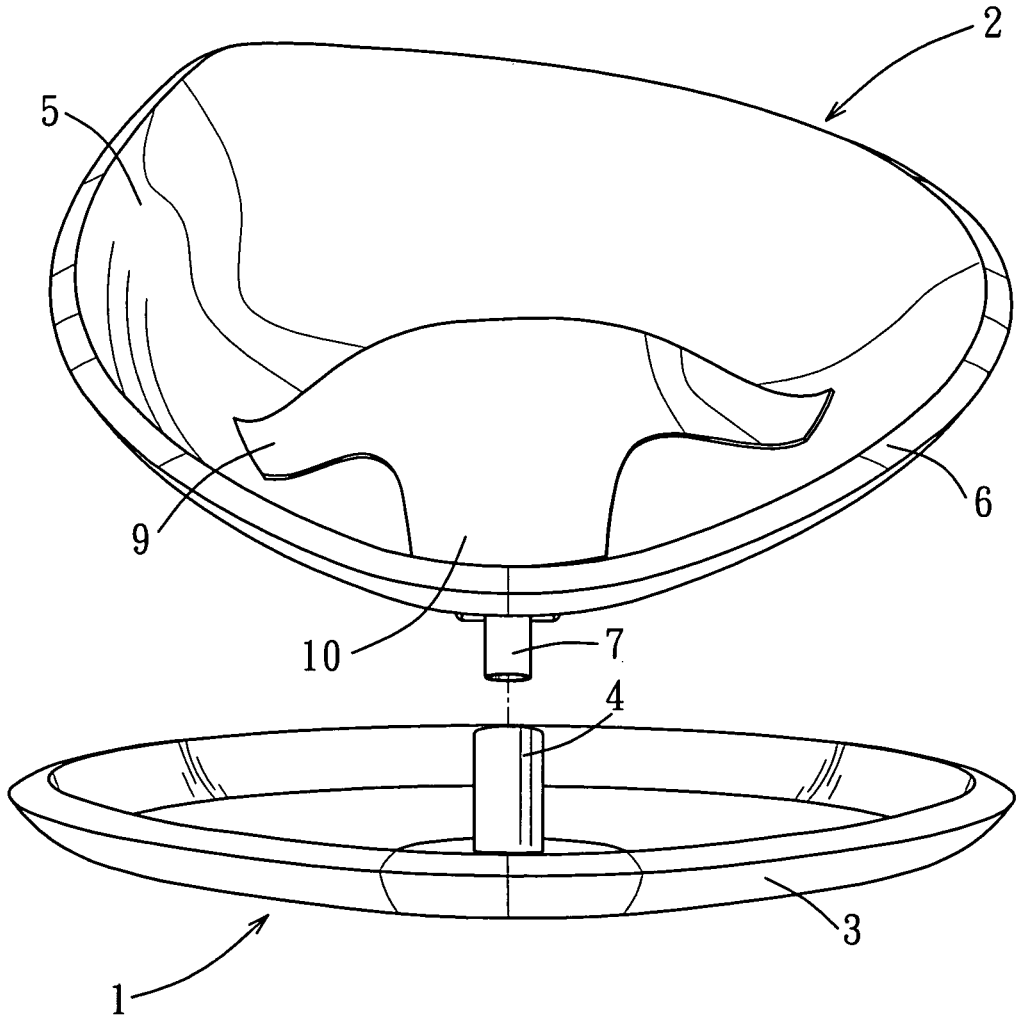
FIG. 2 is a front view of the dismounted swing chair of FIG. 1.
Figure 3:
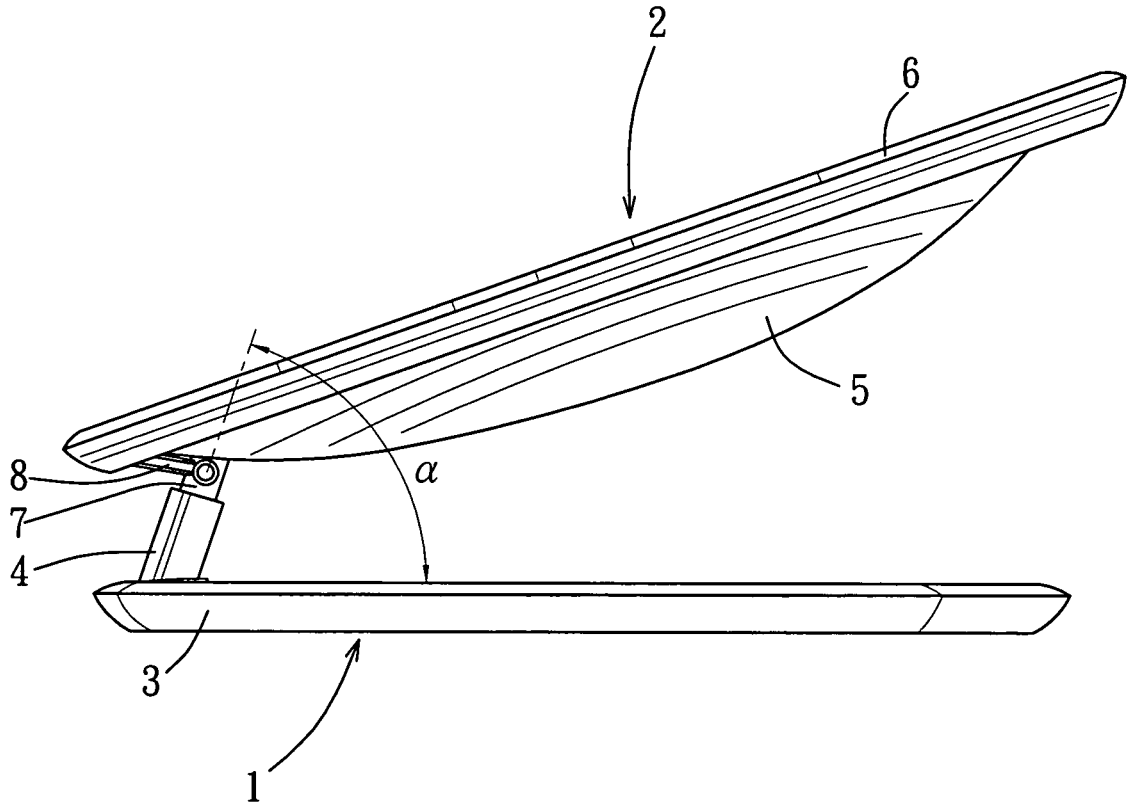
FIG. 3 is a side view of the swing chair of FIG. 1.

According to the figures the swing chair comprises a base frame 1 and a support or chair 2. The chair 2 can rotate freely in the base frame 1. The base frame 1 is substantially an 0-shaped, oval metal ring 3 having a tube 4 connected thereto at one side, which tube 4 inclines upwardly and towards a central axis of the oval ring 3. Several ball bearings extend axially inside the tube 4, which bearings together show a central axial tubular opening. An angle $\alpha$ between a floor plane and an axis of the bearings is 71° . The base frame may in alternative preferred embodiments be Y-shaped or V-shaped, with the tube being mounted on the bottom tip of the Y or V.

The chair 2 is substantially a shell shaped element 5, having a metal substantially oval ("0") shaped edge 6, and having a metal shaft 7 connected to the metal edge 6 by means of a short, substantially horizontal, connecting bar 8 near one of the outer ends of the oval edge. In an alternative embodiment the tube 4 may be mounted on the chair 2, and the shaft 7 is then mounted on the base frame 1. The chair 2 may for instance consist of a substantially 0-shaped, oval metal ring 6 and a flexible cloth 5 or a hard plastic shell 5 attached thereto. A diameter of the shaft 7 is equal to a diameter of the central opening of the bearings in the tube 4, such that the shaft 7 can be easily inserted therein without play. An angle between the shaft 7 and a plane of the oval edge 6 is 51°, the shaft 7 being inclined away from a central axis of the oval edge 6. The chair 2 further comprises a bumper bar 9 and a crotch bar 10 to keep a baby or a child in place while seated.

The chair 2 is mounted on the base frame 1 by inserting the shaft 7 in the central opening of the bearings in the tube 4.

Thereby an angle between the plane of the oval metal ring 6 of the chair 2 and the floor plane is 20° in the neutral position of the chair 2.

In use, a baby or a child can be seated in the chair 2. Because the centre of gravity of the child and the chair 2 is below the axis of rotation of the chair 2, the chair 2 will swing back-and-forth sideways when pushed out of balance. Preferably the lateral amplitude of the swing movement is limited towards both sides, for instance by shock absorbing stops, which are for instance made of rubber, and which are preferably provided inside the tube 4.

Because the shape and dimensions of the base frame 1 and the chair's edge 6 are substantially identical, both parts 1, 2 of the swing chair can be easily dismounted and moved flat against each other, such that a compact, substantially flat assembly is obtained for storage.

Although the invention is described herein by way of the preferred embodiment as an example, the man skilled in the art will appreciate that many modifications and variations are possible within the scope of the invention.

What is claimed is:

1. A swing chair comprising a base frame configured to rest on a floor, the base frame defining a base frame plane adapted in use to be coincident with a plane of the floor; and a support having a support surface arranged to support a baby or a child, wherein the support is rotatably and eccentrically connected with the base frame by a bearing so that the support swings relative to the base frame about an axis of rotation that is eccentric to the base frame, wherein the axis of rotation and the base frame plane are not mutually perpendicular, wherein the support has a lowest surface that extends from a highest portion to a lowest portion, the bearing is connected with the support proximate to the lowest portion of the support lowest surface, and wherein the support has a center of gravity that is below the axis of rotation such that under the influence of gravity the support will swing in a reciprocating manner in overlying relation to the base frame.

2. The swing chair according to claim 1, wherein the bearing is connected with the base frame near a horizontal edge of the base frame, and the axis of the bearing is inclined in an upward direction towards a vertical axis through a centre of the base frame.

3. The swing chair according to claim 1, wherein in its neutral position the support is generally inclined from the bearing in an upward direction towards a vertical axis through a centre of the base frame.

4. The swing chair according to claim 1, wherein the support surface is substantially shell shaped.

5. The swing chair according to claim 1, wherein the support is substantially shell shaped.

6. The swing chair according to claim 1, wherein the bearing is comprised of a tube connected to one of the base frame and a support at one end and being open at its other end, and a shaft connected at one end to the other one of the base frame and the support, said shaft being rotatably mounted in said tube.

7. The swing chair according claim 6, wherein said shaft is movable in an axial direction out of said tube, so that the support can be dismounted from the base frame.

8. A swing chair comprising a base frame configured to rest on a floor, the base frame defining a base frame plane adapted in use to be coincident with a plane of the floor; and a support arranged to support a baby or a child, wherein the support is rotatably and eccentrically connected with the base frame by a bearing so that the support swings relative to the base frame about an axis of rotation that is eccentric to the base frame, wherein the axis of rotation and the base frame plane are not mutually perpendicular, wherein the support is one piece that extends from a higher portion to a lower portion, the bearing is directly connected with the support so that the axis of rotation passes through the support proximate to the lower portion of the support surface, and wherein the support has a center of gravity that is below the axis of rotation such that under the influence of gravity the support will swing in a reciprocating manner in overlying relation to the base frame.

9. The swing chair according to claim 8, wherein the bearing is connected with the base frame near a horizontal edge of the base frame, and the axis of the bearing is inclined in an upward direction towards a vertical axis through a centre of the base frame.

10. The swing chair according to claim 8, wherein in its neutral position the support is generally inclined from the bearing in an upward direction towards a vertical axis through a centre of the base frame.

11. The swing chair according to claim 8, wherein the support surface is substantially shell shaped.

12. The swing chair according to claim 8, wherein the support is substantially shell shaped.

13. The swing chair according to claim 8, wherein the bearing is comprised of a tube connected to one of the base frame and a support at one end and being open at its other end, and a shaft connected at one end to the other one of the base frame and the support, said shaft being rotatably mounted in said tube.

14. The swing chair according claim 13, wherein said shaft is movable in an axial direction out of said tube, so that the support can be dismounted from the base frame.

15. A swing chair comprising a base frame configured to rest on a floor, the base frame defining a base frame plane adapted in use to be coincident with a plane of the floor; and a support arranged to support a baby or a child, wherein the support is rotatably and eccentrically connected with the base frame by a bearing so that the support swings relative to the base frame about an axis of rotation that is eccentric to the base frame, wherein the axis of rotation and the base frame plane are not mutually perpendicular, wherein the support extends from a higher portion to a lower portion, the bearing has a connection with the support proximate to the lower portion of the support, the entire support extends upwardly from the bearing connection, and wherein the support has a center of gravity that is below the axis of rotation such that under the influence of gravity the support will swing in a reciprocating manner in overlying relation to the base frame.

16. The swing chair according to claim 15, wherein the bearing is connected with the base frame near a horizontal edge of the base frame, and the axis of the bearing is inclined in an upward direction towards a vertical axis through a centre of the base frame.

17. The swing chair according to claim 15, wherein in its neutral position the support is generally inclined from the bearing in an upward direction towards a vertical axis through a centre of the base frame.

18. The swing chair according to claim 15, wherein the support surface is substantially shell shaped.

19. The swing chair according to claim 15, wherein the support is substantially shell shaped.

20. The swing chair according to claim 15, wherein the bearing is comprised of a tube connected to one of the base frame and a support at one end and being open at its other end, and a shaft connected at one end to the other one of the base frame and the support, said shaft being rotatably mounted in said tube.

21. The swing chair according claim 20, wherein said shaft is movable in an axial direction out of said tube, so that the support can be dismounted from the base frame.

22. A swing chair comprising a base frame configured to rest on a floor, the base frame defining a base frame plane adapted in use to be coincident with a plane of the floor; and a support having a support surface arranged to support a baby or a child, wherein the support is rotatably and eccentrically connected with the base frame by a bearing at a bearing connection so that the support swings relative to the base frame about an axis of rotation that is eccentric to the base frame, wherein the axis of rotation and the base frame plane are not mutually perpendicular, wherein the support has a lower surface that extends from a higher portion to a lower portion, the bearing is connected with the support proximate to the lower portion of the support lower surface, and wherein the support has a center of gravity that is below the axis of rotation and above a plane that is parallel to the base frame plane and passes through the bearing connection such that under the influence of gravity the support will swing in a reciprocating manner in overlying relation to the base frame.

23. The swing chair according to claim 22, wherein the bearing is connected with the base frame near a horizontal edge of the base frame, and the axis of the bearing is inclined in an upward direction towards a vertical axis through a centre of the base frame.

24. The swing chair according to claim 22, wherein in its neutral position the support is generally inclined from the bearing in an upward direction towards a vertical axis through a centre of the base frame.

25. The swing chair according to claim 22, wherein the support surface is substantially shell shaped.

26. The swing chair according to claim 22, wherein the support is substantially shell shaped.

27. The swing chair according to claim 22, wherein the bearing is comprised of a tube connected to one of the base frame and a support at one end and being open at its other end, and a shaft connected at one end to the other one of the base frame and the support, said shaft being rotatably mounted in said tube.

28. The swing chair according claim 27, wherein said shaft is movable in an axial direction out of said tube, so that the support can be dismounted from the base frame.

* * * * *